US008485152B2

(12) United States Patent
Boegershausen et al.

(10) Patent No.: US 8,485,152 B2
(45) Date of Patent: Jul. 16, 2013

(54) SWITCHABLE PRESSURE SUPPLY DEVICE COMPRISING A PASSIVE AUXILIARY PRESSURE ACCUMULATOR

(75) Inventors: Mathias Boegershausen, Puschendorf (DE); Michael Busse, Herzogenaurach (DE); Eduard Golovatai-Schmidt, Hemhofen (DE); Andreas Strauss, Forchheim (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/510,694

(22) PCT Filed: Nov. 17, 2010

(86) PCT No.: PCT/EP2010/067657

§ 371 (c)(1),
(2), (4) Date: May 18, 2012

(87) PCT Pub. No.: WO2011/061216

PCT Pub. Date: May 26, 2011

(65) Prior Publication Data

US 2012/0240888 A1 Sep. 27, 2012

(30) Foreign Application Priority Data

Nov. 20, 2009 (DE) ..... 10 2009 054 051

(51) Int. Cl.
*F01L 1/047* (2006.01)

(52) U.S. Cl.
USPC ..... 123/90.34; 123/90.17

(58) Field of Classification Search
USPC ..... 123/90.6, 90.15, 90.12, 90.17, 90.16, 123/90.34
See application file for complete search history.

(56) References Cited

U.S. PATENT DOCUMENTS

| | | | | |
|---|---|---|---|---|
| 6,871,620 | B2 * | 3/2005 | Aimone | 123/90.17 |
| 2003/0188705 | A1 | 10/2003 | Aimone | |

FOREIGN PATENT DOCUMENTS

| | | |
|---|---|---|
| DE | 4323133 | 1/1994 |
| DE | 19615076 | 6/1997 |
| DE | 19908934 | 9/2000 |
| DE | 19616973 | 11/2003 |
| DE | 19727180 | 12/2003 |
| DE | 10228354 | 1/2004 |
| DE | 10239207 | 3/2004 |
| DE | 202005008264 | 9/2005 |
| DE | 102005013141 | 9/2006 |
| DE | 102007056684 | 5/2009 |
| EP | 1197641 | 4/2002 |

(Continued)

*Primary Examiner* — Zelalem Eshete
(74) *Attorney, Agent, or Firm* — Volpe and Koenig, P.C.

(57) ABSTRACT

A switchable device for supplying at least one consumer of an internal combustion engine with pressure, comprising: a cavity formed inside a camshaft; a first displacement element arranged in the cavity having a first pressure surface which at least partially delimits a first accumulator chamber together with the wall of the cavity; a first energy accumulator which interacts with the first displacement element; a locking mechanism by which the first displacement element can be locked in the second end position; a switching mechanism which can be actuated by an actuator, having a switch element that can be brought into at least two switching positions; a second displacement element arranged in the cavity having a second pressure surface which at least partially delimits a second accumulator chamber together with the wall of the cavity; a second energy accumulator which interacts with the second displacement element; the first accumulator chamber and the second accumulator chamber communicating with each other and being connectible to a pressure source in a fluid-conducting manner.

15 Claims, 5 Drawing Sheets

FOREIGN PATENT DOCUMENTS

| | | |
|---|---|---|
| EP | 1596040 | 11/2005 |
| EP | 1596041 | 11/2005 |
| WO | 2006039966 | 4/2006 |
| WO | 2008140897 | 11/2008 |

* cited by examiner

SWITCHABLE PRESSURE SUPPLY DEVICE COMPRISING A PASSIVE AUXILIARY PRESSURE ACCUMULATOR

FIELD OF THE INVENTION

The invention lies in the technical field of internal combustion engines and relates to a switchable device integrated in a cavity of a camshaft for supplying pressure to loads of an internal combustion engine.

BACKGROUND

From Patent No. EP 1197641 A2, a pressure accumulator for supporting a hydraulically adjustable camshaft is known in which the flow of hydraulic fluid into or out of the pressure accumulator is controlled by the use of different solenoid valves.

A pressure accumulator with a separate housing is further known from the German Laid Open Patent Application DE 102007056684 A1 of the applicant.

SUMMARY

Accordingly, the objective of the present invention is to improve conventional pressure accumulators for supplying pressure to loads in an internal combustion engine in an advantageous manner.

This and other objects are met according to the invention by a switchable device for supplying pressure with the features of the main claim. Advantageous constructions of the invention are specified by the features of the subordinate claims.

According to the invention, a switchable device for supplying pressure to at least one load of an internal combustion engine is shown. The load can involve, in particular, a hydraulic camshaft adjuster for adjusting the phase position between the crankshaft and camshaft. It is also conceivable, however, that the device is used, for example, in an electrohydraulic valve actuation device of an internal combustion engine.

The device for supplying pressure comprises an active (switchable) pressure accumulator and a passive (non-switchable) pressure accumulator, each of which are integrated in a cavity of a camshaft.

The active pressure accumulator comprises a first displacement element that is arranged in the cavity and can be displaced between a first end position and a second end position. The first displacement element has a first pressure surface that at least partially bounds, together with a wall of the cavity, a first storage space that can be connected or is connected in a fluid-conducting manner to the load. The displacement element can be constructed, for example, in the form of a piston with an end-side pressure surface.

The active pressure accumulator further comprises a first force accumulator that interacts with the first displacement element so that the first displacement element can be displaced by pressurization of the first storage space against the force of the first force accumulator from the first end position into the second end position. The first force accumulator is constructed, for example, as a spring element, in particular, in the form of a compression spring, wherein any other suitable spring type could also be used.

The active pressure accumulator further comprises a locking mechanism through which the first displacement element can be locked detachably in the second end position in which the first force accumulator is clamped.

The active pressure accumulator further comprises a switching mechanism with a switch element, wherein this switching mechanism is actuated by an actuator and can be brought into at least two switch positions, wherein the switch element interacts with the locking mechanism so that the locking of the first displacement element is maintained in a first switch position and is released in a second switch position. Advantageously, the switching element can be displaced between the two switch positions by an actuator rotationally decoupled from the camshaft.

The passive pressure accumulator comprises a second displacement element that is arranged in the cavity and can be displaced between a first end position and a second end position. Here, the second displacement element is provided with a second pressure surface that at least partially bounds, together with the wall of the cavity, a second storage space.

The passive pressure accumulator further comprises a second force accumulator that interacts with the second displacement element, wherein the second displacement element can be displaced by the pressurization of the second storage space against the force of the second force accumulator from the first end position into the second end position.

In the device according to the invention, the first storage space and the second storage space communicate with each other, i.e., are in constant fluid-conducting connection and can be connected or are connected in a fluid-conducting manner to a pressure source or pressurized medium source. For example, the two storage spaces are connected to the lubricating oil circuit of the internal combustion engine, wherein an oil pump acts as a pressure source and oil of the lubricating oil circuit is used as the pressurized medium.

For relatively low installation space requirements, the device according to the invention allows a more reliable and more secure supply of pressure to the loads of an internal combustion engine that is provided independent of the pressure in the lubricating circuit of the internal combustion engine. Here, a relatively large pressurized medium volume can be provided by the two storage spaces. One special advantage of the device according to the invention is produced in that the passive pressure accumulator is used for supplying pressure to loads while the internal combustion engine is running, while the active pressure accumulator can be used only for starting the internal combustion engine and is charged for the next start while the internal combustion engine is running.

In one advantageous construction of the device according to the invention for supplying pressure, the second storage space is arranged between the first storage space and the load, so that the load, for example, a hydraulic camshaft adjuster, can be easily supplied with pressurized medium when the internal combustion engine is running.

In another advantageous construction of the device according to the invention, the second storage space can be connected or is connected in a fluid-conducting manner to the pressure source and to the load with at least one leakage prevention device provided in-between. The leakage prevention device is constructed so that it allows the through flow of pressurized medium, while it blocks the through flow of non-pressurized medium merely at the hydrostatic pressure. Thus, the leakage prevention device can prevent leakage from the storage space if insufficient pressure is supplied by the pressure source, for example, in the case of insufficient output from the oil pump. The leakage prevention device can be used as a limit for the second storage space and can form, in particular, a stop for the second displacement element in the first end position. The construction of such a leakage prevention device is known to someone skilled in the art and is described in the patent literature, for example, in DE 19615076.

In another advantageous construction of the device according to the invention, there is a support element that is connected rigidly to the camshaft and on which the second force accumulator of the second displacement element is supported. Here it can be advantageous if the support element is used as a stop for the first displacement element in the first end position.

In another advantageous construction of the device according to the invention, a hollow guide element guiding the second displacement element is held in a passage opening of the support element. The two storage spaces communicate with each other via the cavity of this guide element. The provision of a support element, in particular, with a guide element, allows an especially simple technical realization of the device for supplying pressure.

In another advantageous construction of the device according to the invention, the active accumulator comprises a ball carrier that is connected rigidly to the camshaft and surrounds the switch element. The ball carrier has a plurality of openings in each of which a ball is held so that it can move freely in the radial direction. Here, the balls are supported in the radial direction by a support surface formed by the switch element. In this construction of the device, it further comprises a locking element that is connected rigidly to the first displacement element and is provided with a locking section that is led into engagement with the balls in the second end position of the first displacement element, for example, in that it engages behind these balls, in order to lock the first displacement element on the camshaft. On the other side, the locking element is not led into engagement with the balls in the first end position of the first displacement body, so that the first displacement element is not locked. In this construction of the device, a first non-return element is also provided that is arranged so that the switch element can be displaced by the actuator relative to the ball carrier against the force of the first non-return element from the first switch position into the second switch position. The first non-return element is constructed, for example, as a spring element, in particular, in the form of a compression spring, wherein any other suitable spring type could also be used. In this construction of the device, the support surface of the switch element is provided with at least one recess that is allocated to the balls and is constructed and arranged so that the balls can be held at least partially in the recess in the second switch position of the switch element, so that the locking section is led out of engagement with the balls and the locking of the first displacement element is released. On the other side, the balls are not held by the recess of the support surface in the first switch position of the switch element, so that the locking of the first displacement element is maintained.

These measures allow a technically especially simple realization of the locking and switch mechanism of the active pressure accumulator, wherein the device for supplying pressure is distinguished by an especially good response behavior.

In the above construction of the invention, it can also be advantageous if a sliding element is provided that can be displaced by the first displacement element against the force of a second restoring element, wherein the sliding element is constructed so that it slides around the balls for securing them in their radial position in the first end position of the first displacement element and releases these balls in the second end position. Thus the sliding element forms a captive securing device for the balls when these are not in engagement with the locking section of the first locking element. The second restoring element is constructed, for example, as a spring element, in particular, in the form of a compression spring, wherein any other suitable type of spring could also be used.

In another advantageous construction of the device according to the invention for supplying pressure, this is provided with a sealing element that seals the camshaft to the outside and on which the first force accumulator of the first displacement element is supported. The sealing element can be used here especially for securing the position of the force accumulator.

In another advantageous construction of the device according to the invention, the pressure source can be connected or is connected in a fluid-conducting manner via a non-return valve that forms a block in the direction toward the pressure source to the load and to the two storage spaces.

In the device according to the invention, it can be advantageous when it is connected to the lubricating oil circuit of the internal combustion engine, so that oil from the lubricating oil circuit is used as the pressurized medium.

The invention further extends to an internal combustion engine that is equipped with at least one device that can be switched as described above for supplying pressure to at least one load.

BRIEF DESCRIPTION OF THE DRAWINGS

The invention will now be explained in more detail with reference to an embodiment, wherein reference is made to the accompanying drawings. Elements that are identical or have identical actions are designated in the drawings with the same reference symbols. Shown are.

DETAILED DESCRIPTION OF THE PREFERRED EMBODIMENTS

Figure 1:
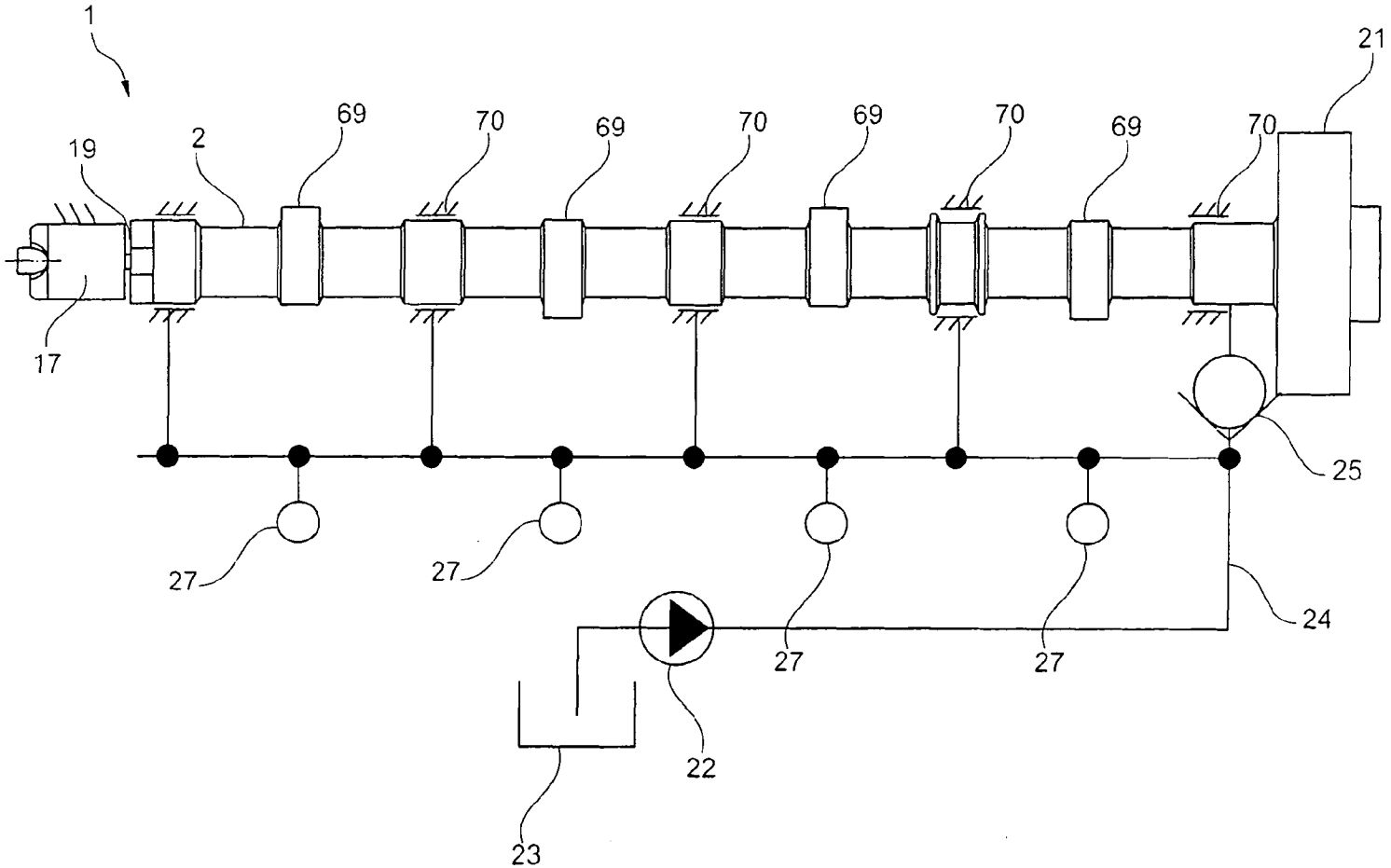
FIG. 1 is a schematic overview diagram, with reference to which the connection of the device for supplying pressure from FIG. 1 to the lubricating oil circuit of an internal combustion engine is illustrated.

In the figures, an embodiment of the device according to the invention for supplying pressure to loads of an internal combustion engine is shown. The device designated overall with the reference number 1 comprises a camshaft 2 that is built-up as an example here and has a plurality of cams 69 and is supported so that it can be rotated about a central rotational axis 7 on the bearing points 70. The same would also be conceivable, however, if the camshaft 2 was produced in a foundry process.

Figure 3:
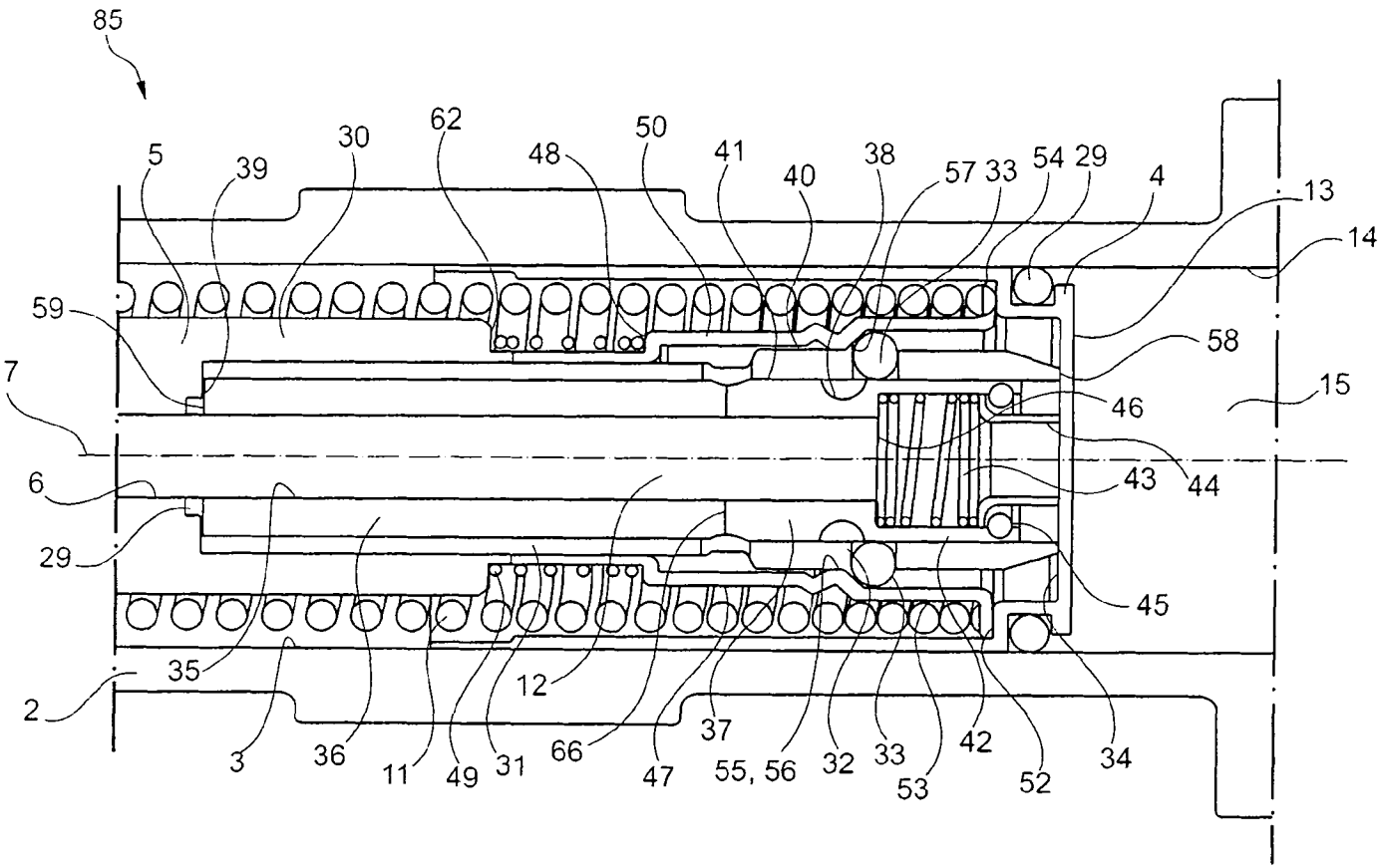
FIG. 3 is an enlarged section from FIG. 2 for illustrating the active pressure accumulator of the device for supplying pressure with a locked switch element.
Figure 4:
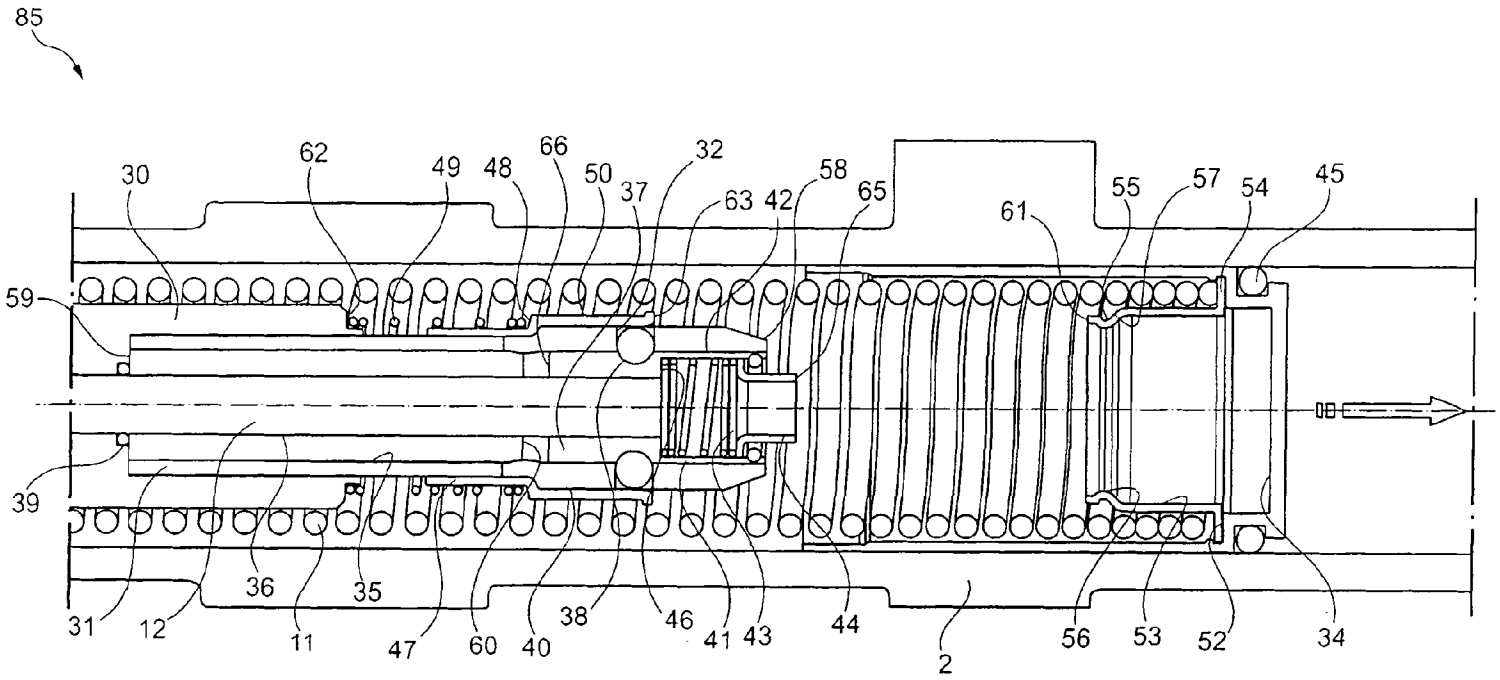
FIG. 4 is an enlarged section from FIG. 2 for illustrating the active pressure accumulator of the device for supplying pressure with a released switch element.
Figure 5:
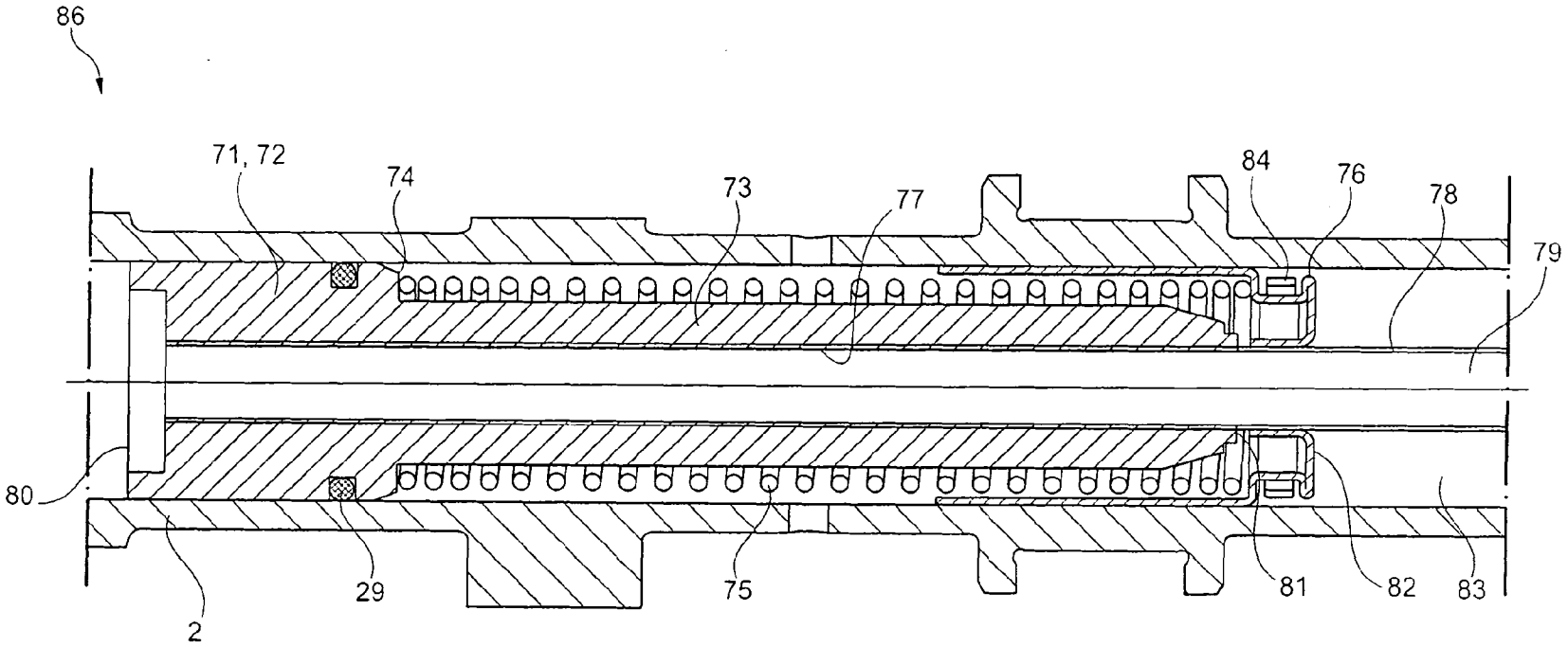
FIG. 5 is an enlarged section from FIG. 2 for illustrating the passive pressure accumulator of the device for supplying pressure with a released switch element.

An active (switchable) pressure accumulator 85 and a passive pressure accumulator 86 are integrated in the camshaft 2. The active pressure accumulator 85 is shown enlarged in FIG. 3 and FIG. 4, wherein FIG. 3 corresponds to a charged (tensioned) state and FIG. 4 shows the torque absorbed during the pressure-release process. In FIG. 5, the passive pressure accumulator 86 is shown enlarged in a charged state. A cavity 3 is left open in the camshaft 2 for integrating the two pressure accumulators 85, 86.

For forming the active pressure accumulator 85, a first displacement element constructed in the form of a first piston 4 is held in the cavity 3 so that it can be displaced in the axial direction. In addition, a sealing body 5 constructed in the form of a stepped cylinder can be pressed into the cavity 3 of the camshaft 2 that extends from one end of the camshaft 2 into the cavity 3. In this way, the sealing body 5 can be divided into a terminal first section 8 with larger diameter and an adjacent second section 9 with smaller diameter, wherein a ring stage 10 is produced. A first force accumulator spring (helical compression spring) 11 used as a first force accumulator is supported with one of its ends on the ring stage 10 of the sealing body 5. With its other end, this first force accumulator contacts the first piston 4.

The sealing body 5 connected rigidly to the camshaft 2 is further provided with a central axial bore 6 in which a switch rod 12 is held so that it can be displaced in the axial direction. The switch rod 12 can be actuated by an electromagnetic actuator 17 that is arranged on one end of the camshaft 2, wherein a tappet 19 engages an end-side impact surface 18 of the switch rod 12 for this purpose. The switch rod 12 is part of a switch mechanism for releasing a locking mechanism for the first piston 4 that will be explained in more detail farther below.

For forming the passive pressure accumulator 86, a second displacement element constructed in the form of a second piston 76 is held in the cavity 3 of the camshaft 2 so that it can be displaced in the axial direction. In addition, a support body 71 constructed in the form of a stepped cylinder is pressed into the cavity 3 of the camshaft 2. It can be divided into a first section 72 with larger diameter and an adjacent second section 73 with smaller diameter, wherein a ring stage 74 is produced. A second force accumulator spring (helical compression spring) 76 used as a second force accumulator is supported on the ring stage 74 of the support body 71. With its other end, the second force accumulator spring contacts the second piston 76. In a central passage bore 77 of the support body 71, a hollow tube 78 is held on which the second piston 76 is supported so that it can be displaced in the axial direction. By means of a sealing element 84, the second piston 76 forms a low-friction contact with the wall 14 of the cavity 3 of the camshaft 2, wherein the sealing element 84 provides an oil-tight connection between the second piston 76 and the wall 14. A ring seal 29 is further provided between the first section 72 of the support body 71 and the wall 14.

The piston 4 has an end-side first pressure surface 13 that defines a first storage space 15 for pressurized oil 28 together with an (inner) wall 14 of the hollow space 3 of the camshaft 2 and an end surface 80 of the support body 71 facing the first piston 4. Through a plurality of ring seals 29, the first storage space 15 is sealed oil-tight to the outside. On the other hand, the second piston 76 has an end-side second pressure surface 82 that defines a second storage space 83 for pressurized oil 28 together with the wall 14 of the cavity 3 of the camshaft 2 and a leakage prevention device 16. Here, the first storage space 15 communicates with the second storage space 83 via the cavity 79 of the hollow tube 78.

Opposite the actuator 17, a hydraulic camshaft adjuster 21 is attached, for example, by means of a (not shown) central screw to the end side of the camshaft 2. As usual, the hydraulic camshaft adjuster 21 comprises a drive part in drive connection with the crankshaft via a drive wheel and a camshaft-fixed driven part, as well as a hydraulic actuating drive that is switched between a drive part and a driven part and transfers the torque from the drive part to the driven part and allows an adjustment and fixing of the rotational position between these parts. The hydraulic actuating drive is provided with at least one pressure chamber pair that act against each other and can be selectively pressurized with pressurized oil, in order to generate a change in the rotational position between the drive part and driven part by generating a pressure drop across the two pressure chambers.

Hydraulic camshaft adjusters as such are well known to someone skilled in the art and described in detail, for example, in publications DE 202005008264 U1, EP 1596040 A2, DE 102005013141 A1, DE 19908934 A1, and WO 2006/039966 of the applicant, so that more exact details do not need to be discussed here.

In the central screw for fastening the camshaft adjuster 21 to the camshaft 2, a control valve not shown in more detail is arranged for controlling the oil flows. This control valve can connect the pressure chambers of the camshaft adjuster 21 in a fluid-conducting manner via oil paths 26 selectively with a pressure source or pressurized medium source constructed in the form of an oil pump 22 or with an oil tank 23. Such control valves are well known as such to someone skilled in the art and described in detail, for example, in the German Patent DE 19727180 C2, the German Patent DE 19616973 C2, the European Patent Application EP 1 596 041 A2, and the German Laid Open Patent Application DE 102 39 207 A1 of the applicant, so that more exact details do not have to be discussed here.

Figure 2:
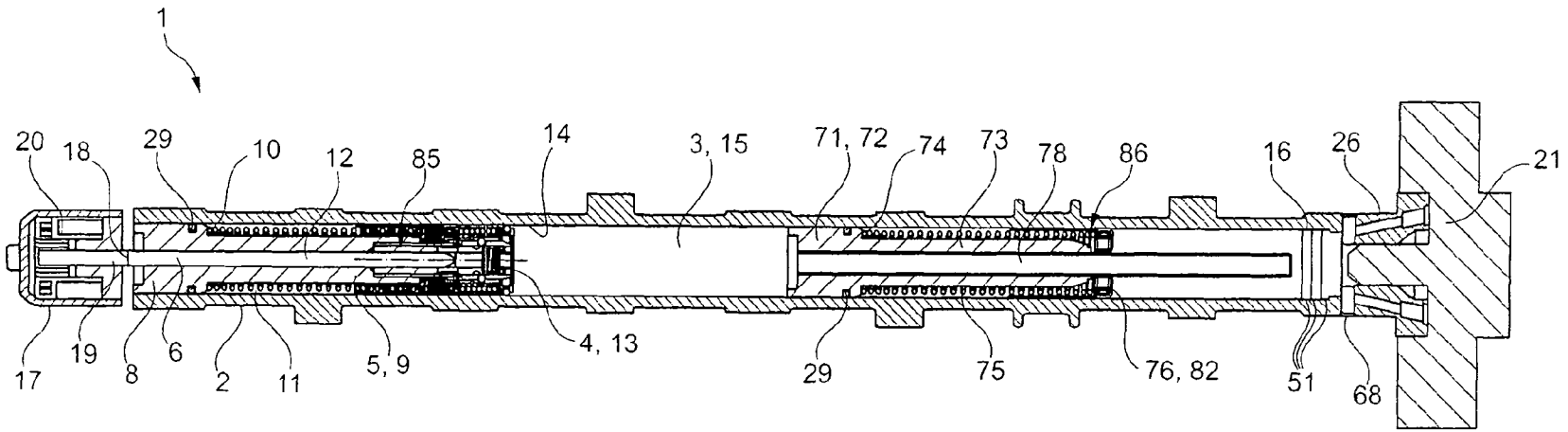
FIG. 2 is a schematic axial section diagram of an embodiment of the device according to the invention for supplying pressure.

As can be taken from FIG. 2, the second storage space 83 is connected in a fluid-conducting manner to the oil pump 22 via a pressure line 24. The pressure line 24 here opens upstream of the leakage prevention device 16 into pressure channels 68 that are in fluid-conducting connection to the oil paths 26 via the control valve and to the second storage space 83. Thus, both the two storage spaces 15, 83 and also the hydraulic camshaft adjuster 21 are connected in a fluid-conducting manner to the oil pump 22 via the pressure line 24. A non-return valve 25 that is arranged in the pressure line 24 and forms a block in the direction toward the oil pump 22 prevents a return flow of pressurized oil in the case of reduced or insufficient output from the oil pump 22.

In the internal combustion engine, additional loads are connected upstream of the non-return valve 25 to the pressure line 24, such as support elements 27 and the bearing points 70 of the camshaft 2 that must be supplied with pressurized oil 28.

If the first storage space 15 and the second storage space 83 that can communicate with each other via the hollow tube 78 are now loaded with pressurized oil via the pressure line 24, the first piston 4 can be pushed against the spring force of the first force accumulator spring 11 by pressurization of the first storage space 15 and the second piston 76 can be pushed against the spring force of the second force accumulator spring 76 by pressurization of the second storage space 83. Here, the pressurized oil 28 passes through the leakage prevention device 16 that is transmissible for pressurized pressurized oil 28. Here, the second piston 76 is pushed from a first end position in which it contacts the leakage prevention device 16 into a second end position in which the second force accumulator spring 76 is tensioned or is more strongly tensioned in the presence of a biasing tension. Furthermore, the first piston 4 is pushed from a first end position in which it contacts the support body 71 into a second end position in which the first force accumulator spring 11 is tensioned or is more strongly tensioned in the presence of a biasing tension.

The spring force of the first force accumulator spring 11 is greater than the spring force of the second force accumulator spring 76, so that when the communicating storage spaces 15, 83 are pressurized, the second force accumulator spring 76 is compressed preferentially before the first force accumulator spring 11. The spring force of the first force accumulator spring 11 can be designed, for example, with reference to a maximum oil pressure in the cylinder head, while the spring force of the second force accumulator spring 76 can be given from the characteristic map of the hydraulic camshaft adjuster 21.

In contrast to the second piston 76, in the second end position, the first piston 4 can be locked by a locking mechanism. The locking mechanism thus comprises a sleeve-shaped ball carrier 31 that is pressed into a sleeve-shaped end section 30 of the sealing body 5 and has a plurality of radial bores 32 arranged distributed in the peripheral direction. A ball 33 is held in each of these bores. Here, the bores 32 each have a larger diameter than the balls 33, so that these are freely moveable in the radial direction in the bores 32. The ball carrier 31 is provided with an end surface 58 on its side facing away from the sealing body 5.

Furthermore, a sleeve body 36 is pressed into a hollow space 35 of the ball carrier 31, wherein this sleeve body contacts a shoulder 39 of the sealing body 5 with a first end surface 59 facing away from the first piston 4, and wherein oil tightness is ensured by an intermediary ring seal 29. An opposite second end surface 60 of the sleeve body 36 forms an end stop for a switch pin 37 connected rigidly to the switch rod 12.

An outer lateral surface 41 of the switch pin 37 is provided with a ring groove 38 whose axial section has a ball-shell shape and is allocated to the balls 33. On its end facing away from the sleeve body 36, the switch pin 37 is provided with a sleeve-shaped end section 42 in which a restoring spring 43 is held. The restoring spring 43 is supported with its one end on a ring stage 46 shaped by the switch pin 37 and is supported with its other end on a punch 44. In the locked position of the first piston 4 shown in FIG. 3, the punch 44 contacts an inner surface 34 of the first piston 4. The punch 44 is secured by a snap ring 45 against falling out from the end section 42 of the switch pin 37.

Furthermore, on an outer lateral surface 40 of the ball carrier 31, an at least approximately sleeve-shaped sliding body 47 is arranged so that it can move in the axial direction relative to the ball carrier 31. The sliding body 47 is loaded by a sliding spring 49 that is constructed here, for example, as a compression spring. For this purpose, the sliding spring 49 is supported with one end on an end surface 62 of the sealing body 5 and with its other end on a ring stage 48 of the sliding body 47, so that the sliding body 47 is loaded by the spring force of the sliding spring 49 in the direction of the switch pin 37. The sliding body 47 made, for example, from sheet steel is provided with a sliding section 50 that slides into the locked position shown in FIG. 3 over the balls 33 and thus acts as a captive securing device. In contrast, in the non-locked position of the piston 4 shown in FIG. 4, the sliding section 50 releases the balls 33.

The first piston 4 is connected to a sleeve-shaped locking body 53. The locking body 53 is provided with a radially projecting collar 54 that is provided for this purpose and is pressed by the first force accumulator 11 against a shoulder 52 of the first piston 4, so that the locking body 53 is connected by a non-positive fit to the first piston 4. The locking body 53 has a locking section 55 with a radially inward directed ring bead 56 that forms a recess 57.

Now if the two storage spaces 15, 83 are loaded with pressurized oil 28, the second piston 76 is displaced by means of its second pressure surface 82 against the spring force of the second force accumulator spring 76 until the second piston 76 is finally led into contact against the second end surface 81 of the support body 71 that is used as a stop for the second piston 76. In addition, the first piston 4 is displaced by means of its pressure surface 13 against the spring force of the first force accumulator spring 11. Here, an end surface 61 of the locking body 53 comes into contact with a first end surface 63 of the sliding body 47 and displaces this body against the spring force of the sliding spring 49 up to the balls 33 in the region of the recess 57. In addition, the inner surface 34 of the first piston 4 comes into contact with an end surface 65 of the punch 44, wherein the switch pin 37 is displaced in the same direction as the piston 4. Here, the balls 33 are pressed out from the ring groove 38 of the switch pin 37 into the recess 57. This movement of the balls 33 is supported by centrifugal force of the rotating camshaft 2. The balls 33 then contact the outer lateral surface 41 of the switch pin 37, wherein the ring bead 56 engages behind the balls 33. An end surface 66 of the switch pin 37 facing away from the punch 44 is here led into contact with the second end surface 60 of the sleeve body 36 that thus acts as a stop for the switch pin 37. By means of the switch pin 37, the switch rod 12 is displaced in the central axial bore 6 of the sealing piece 5. Finally, the inner surface 34 of the first piston 4 is led into contact with the end surface 58 of the ball carrier 31 that thus acts as a stop for the first piston 4.

If the pressure in the lubricating circuit drops when the internal combustion engine is running, the camshaft adjuster 21 can be provided with pressure by the passive pressure accumulator 86, wherein the second piston 76 is displaced by the spring force of the second force accumulator spring 76 and pressurized oil 28 of the second storage space 83 is pressed through the leakage prevention device 16 into the camshaft adjuster 21. If the oil pump 22 supplies sufficient pressurized oil 28, the passive pressure accumulator 86 is recharged in that the second piston 76 is displaced against the spring force of the second force accumulator spring 76. The leakage prevention device 16 here comprises, for example, three disks 51 that are locked in rotation with each other and are each provided with an eccentric bore, wherein the three bores are each offset relative to each other by 120°. Between the disks 51 there are cavities that allow transport of the pressurized oil 28. This allows pressurized oil 28 to pass the leakage prevention device 16 and blocks the passage of pressurized oil 28 merely at atmospheric or hydrostatic pressure.

Additionally or alternatively, the charged active pressure accumulator 85 can be discharged when the internal combustion engine is running or when the internal combustion engine is started. For this purpose, the locked first piston 4 can be released by a switch mechanism explained in more detail. The first piston 4 can be unlocked in that the switch rod 12 is moved by the tappet 19 contacting the impact surface 18 against the force of the restoring spring 43. The tappet 19 is attached rigidly to a magnetic armature of an electromagnet 20 of the actuator 17 and can be displaced in the axial direction by energizing the magnetic armature. If the magnetic armature is not energized, the switch rod 12 is restored by the spring force of the restoring spring 43. For releasing the lock, the switch rod 12 and the switch pin 37 that contacts the switch rod 12 are displaced by the action of the tappet 19 until the ring groove is aligned with the bores 32 of the ball carrier 31. This has the result that the balls 33 enter into the ring groove 38, so that the ring bead 56 no longer engages behind the balls 33 or the balls 33 come out from the recess 57. The locking section 53 of the locking element 53 thus loses its engagement with the balls 33, wherein the locking of the piston 4 is released.

The first piston 4 is then displaced by the spring force of the first force accumulator spring 11 and the pressurized oil 28 contained in the first storage space 15 is discharged to the camshaft adjuster 21 via the hollow tube 78 and the leakage prevention device 16. The non-return valve 25 prevents pressurized oil 28 from reaching the oil pump 22 and the other loads. Simultaneously, the sliding body 47 is displaced by the spring force of the sliding spring 49, wherein the sliding section 50 slides over the balls 33. When the first piston 4 is displaced by the first force accumulator spring 11, the first end surface 80 of the sliding body 71 forms a stop for the first piston 4.

The device according to the invention thus allows a reliable supply of pressure medium to loads of an internal combustion engine, wherein pressurized oil is provided independent of the oil supply of the internal combustion engine through the active (switchable) pressure accumulator integrated in the camshaft and the passive pressure accumulator. Thus, loads, like the hydraulic camshaft adjuster shown in the exemplary embodiment, can then also be supplied with pressurized oil, when the engine-side oil supply is not sufficient. When the oil pressure drops when the internal combustion engine is running, for example, in the state of hot idling, in the typical way, very hot pressurized oil in connection with a low output of the oil pump leads to a drop in the oil pressure, loads, like the hydraulic camshaft adjuster, can be easily and reliably provided with pressurized oil via the passive pressure accumulator. This can also contribute to improving the adjustment rate of the camshaft adjuster. Because the oil pump needs, on one hand, a certain amount of time after the internal combustion engine starts to build up the necessary oil pressure, an adjustment of the camshaft adjuster into a base position (retarded, middle, advanced position) can take place through the charged active pressure accumulator immediately after the internal combustion engine starts, which is especially suitable in connection with start/stop systems. When the internal combustion engine is running, the passive pressure accumulator can thus be used primarily to compensate oil pressure fluctuations in loads, such as the hydraulic camshaft adjuster. The active pressure accumulator is charged when the internal combustion engine is running and can be discharged when the internal combustion engine starts, in order to supply the hydraulic camshaft adjuster with oil pressure and to shorten the time interval for adjusting the camshaft adjuster by the oil pump. Simultaneously, however, it is also possible that the active pressure accumulator is used when the internal combustion engine is running. The arrangement of the active and passive pressure accumulators in a cavity of the camshaft produces an advantage in terms of installation space compared with external pressure accumulators.

List Of Reference Symbols

1 Device
2 Camshaft
3 Cavity of the camshaft
4 First piston
5 Sealing body
6 Axial bore
7 Rotational axis
8 First section of the sealing body
9 Second section of the sealing body
10 Ring step of the sealing body
11 First force accumulator spring
12 Switch rod
13 First pressure surface
14 Wall
15 Storage room
16 Leakage prevention device
17 Actuator
18 Impact surface
19 Tappet
20 Electromagnet
21 Camshaft adjuster
22 Oil pump
23 Oil tank
24 Pressure line
25 Non-return valve
26 Oil path
27 Support element
28 Pressurized oil
29 Ring seal
30 End section of the sealing body
31 Ball carrier
32 Bore
33 Ball
34 Inner surface
35 Cavity of the ball carrier
36 Sleeve body
37 Switch pin
38 Ring groove
39 Shoulder of the sealing body
40 Outer lateral surface of the ball carrier
41 Outer lateral surface of the switch pin
42 End section of the switch pin
43 Restoring spring
44 Punch
45 Snap ring
46 Ring stage of the switch pin
47 Sliding body
48 Ring stage of the sliding body
49 Sliding spring
50 Sliding section
51 Disk
52 Shoulder of the piston
53 Locking body
54 Collar
55 Locking section
56 Ring bead
57 Recess
58 End surface of the ball carrier
59 First end surface of the sleeve body
60 Second end surface of the sleeve body
61 End surface of the locking body
62 End surface of the sealing body
63 First end surface of the sliding body
64 Second end surface of the sliding body
65 End surface of the punch
66 End surface of the switch pin
67 Connecting space
68 Pressure channel
69 Cams
70 Bearing point
71 Support body
72 First section of the support body
73 Second section of the support body
74 Ring stage of the support body
75 Second force accumulator spring
76 Second piston
77 Passage bore
78 Hollow tube
79 Cavity of the hollow tube
80 First end surface of the support body
81 Second end surface of the support body
82 Second pressure surface
83 Second storage space
84 Sealing element
85 Active pressure accumulator
86 Passive pressure accumulator

The invention claimed is:

1. Switchable device for supplying pressure to at least one load of an internal combustion engine, comprising:

a cavity formed within a camshaft, a first displacement element that is arranged in the cavity and is displaceable between a first end position and a second end position, the first displacement element is provided with a first pressure surface that at least partially borders, together with a wall of the cavity, a first storage space, a first force accumulator interacting with the first displacement element, the first displacement element is displaceable through pressurization of the first storage space against a force of the first force accumulator from the first end position into the second end position, a locking mechanism for locking the first displacement element in the second end position, a switch mechanism actuated by an actuator with a switch element that can be brought into at least first and second switch positions and interacts with the locking mechanism so that the locking of the first displacement element in the first switch position is maintained and in the second switch position is released, a second displacement element that is arranged in the cavity and is displaceable between a first end position and a second end position, wherein the second displacement element is provided with a second pressure surface that at least partially borders, together with the wall of the cavity, a second storage space, a second force accumulator interacting with the second displacement element, the second displacement element is displaceable by pressurization of the second storage space against a force of the second force accumulator from the first end position into the second end position, and the first storage space and the second storage space communicate with each other and are connectable in a fluid-conducting manner to a pressure source.

2. Device for supplying pressure according to claim 1, wherein the second storage space is arranged between the first storage space and the load.

3. Device for supplying pressure according to claim 2, wherein the second storage space is connectable in a fluid-conducting manner to the load and to the pressure source by a leakage prevention device for pressurized medium, and the leakage prevention device is conducting in the presence of pressurization and is blocking in the absence of pressurization.

4. Device for supplying pressure according to claim 3, wherein the leakage prevention device is used as a stop for the second displacement element in the first end position.

5. Device for supplying pressure according to claim 1, further comprising a support element that is connected rigidly to the camshaft and on which the second force accumulator of the second displacement element is supported.

6. Device for supplying pressure according to claim 5, wherein the support element is used as a stop for the first displacement element in the first end position.

7. Device for supplying pressure according to claim 5, wherein a hollow guide element guiding the second displacement element is held in a passage opening of the support element, and the two storage spaces communicate with each other via a cavity of said guide element.

8. Device for supplying pressure according to claim 1 further comprising, a ball carrier connected rigidly to the camshaft and surrounds the switch element, the ball carrier has a plurality of openings in each of which a ball is held so that it can move in a radial direction and is supported in the radial direction by a support surface formed by the switch element, a locking element connected rigidly to the first displacement element and is provided with a locking section that is led into engagement with the balls for locking the displacement element in the second end position, wherein the switch element can be displaced relative to the ball carrier against a force of a first restoring element by the actuator from the first switch position into the second switch position, and the support surface of the switch element is provided with at least one recess such that the balls can be held in the second switch position at least partially by the at least one recess, so that the locking section is led out of engagement with the balls.

9. Device for supplying pressure according to claim 8, further comprising a sliding element that is displaceable by the first displacement element against a force of a second restoring element, the sliding element is constructed so that it slides around the balls in the first end position of the first displacement element and is released in the second end position.

10. Device for supplying pressure according to claim 9, further comprising a sealing element on which the first force accumulator of the first displacement element is supported.

11. Device for supplying pressure according to claim 10, wherein the ball carrier is connected rigidly to the sealing element.

12. Device for supplying pressure according to claim 1, wherein the force accumulators are each constructed as spring elements.

13. Device for supplying pressure according to claim 1, wherein the pressure source is connectable in a fluid-conducting manner to the two storage spaces via at least one non-return valve that forms a block in a direction of a pressure source.

14. Device for supplying pressure according to claim 1, wherein oil from a lubricating oil circuit is used as the pressurized medium.

15. Internal combustion engine with at least on switchable device for supplying pressure to a load according to claim 1.

* * * * *